US007682068B2

(12) United States Patent
Bourgeois

(10) Patent No.: US 7,682,068 B2
(45) Date of Patent: Mar. 23, 2010

(54) TEMPERATURE-COMPENSATED BALANCE WHEEL/HAIRSPRING OSCILLATOR

(75) Inventor: Claude Bourgeois, Bôle (CH)

(73) Assignee: CSEM Centre Suisse d'Electronique et de Microtechniques SA - Recherche et Développement, Neuchâtel (CH)

( * ) Notice: Subject to any disclaimer, the term of this patent is extended or adjusted under 35 U.S.C. 154(b) by 36 days.

(21) Appl. No.: 11/628,831

(22) PCT Filed: Jun. 2, 2005

(86) PCT No.: PCT/EP2005/052520

§ 371 (c)(1),
(2), (4) Date: Dec. 7, 2006

(87) PCT Pub. No.: WO2005/124184

PCT Pub. Date: Dec. 29, 2005

(65) Prior Publication Data

US 2008/0008050 A1 Jan. 10, 2008

(30) Foreign Application Priority Data

Jun. 8, 2004 (EP) ..... 04405355

(51) Int. Cl.
*G04B 17/00* (2006.01)
*G04B 17/04* (2006.01)

(52) U.S. Cl. ..... 368/169; 368/175

(58) Field of Classification Search ..... 368/175, 368/169

See application file for complete search history.

(56) References Cited

U.S. PATENT DOCUMENTS

| | | | | |
|---|---|---|---|---|
| 209,642 | A | 11/1878 | Berlitz et al. | |
| 7,077,562 | B2 * | 7/2006 | Bourgeois et al. | 368/175 |
| 2003/0011119 | A1 | 1/2003 | Imai | |
| 2005/0068852 | A1 * | 3/2005 | Hessler et al. | 368/139 |

FOREIGN PATENT DOCUMENTS

| | | | |
|---|---|---|---|
| EP | 0732635 | A1 | 9/1996 |
| EP | 1422436 | A1 | 5/2004 |

OTHER PUBLICATIONS

Webpage "Good" Fundamental Material Constants for Crystalline Quartz from http://sawyerresearch.com/Misc/Q12_Constants.pdf dated Aug. 11, 2003.
Translation of EP1422436A produced by an automated process available at www.espacenet.com.
Translation of EP0732635A produced by an automated process available at www.espacenet.com.
English Language Abstract of EP1422436A.
English Language Abstract of EP0732635A.

* cited by examiner

*Primary Examiner*—Vit W Miska
*Assistant Examiner*—Sean Kayes
(74) *Attorney, Agent, or Firm*—Townsend M. Belser, Jr.; Nexsen Pruet, LLC

(57) ABSTRACT

The invention relates to mechanical watch oscillators comprising an assembly consisting of a spiral and a temperature compensated balance. The spiral is embodied in a quartz substrate whose section is selected in such a way that the drifts of the spiral and of the balance associated therewith are thermally compensated. The substrate section can be embodied in the form of a section of single or double rotation.

7 Claims, 3 Drawing Sheets

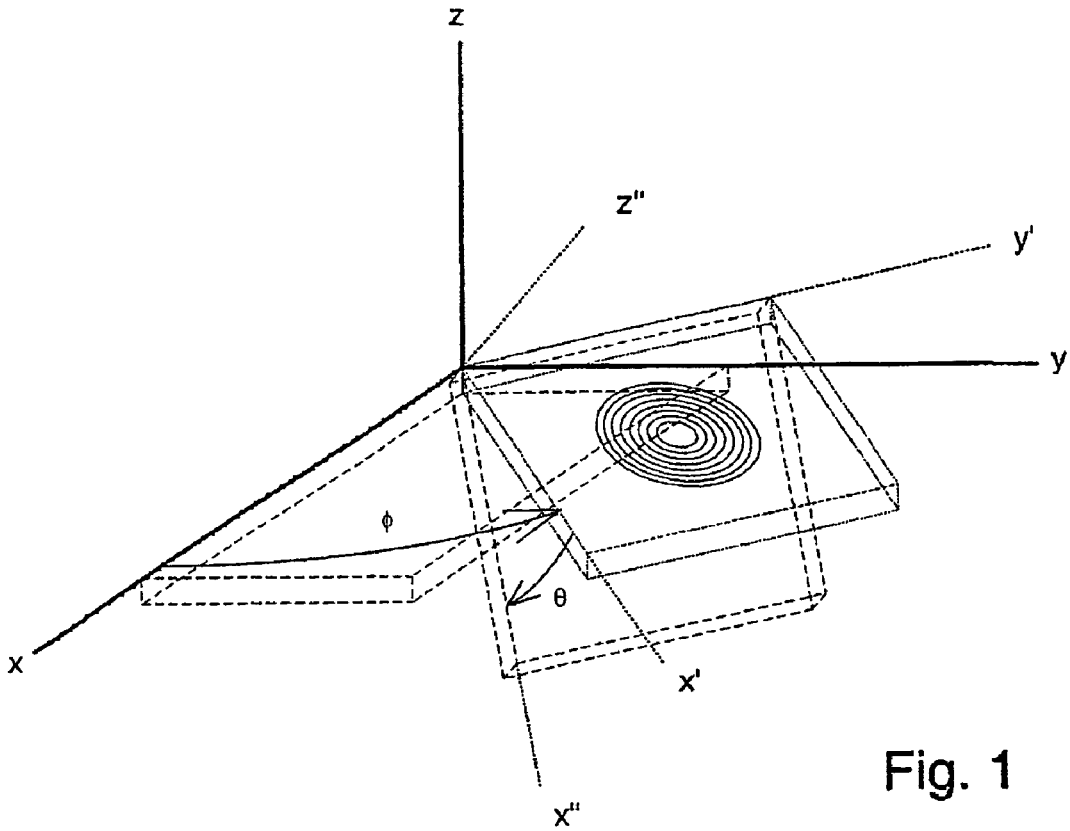
Fig. 1
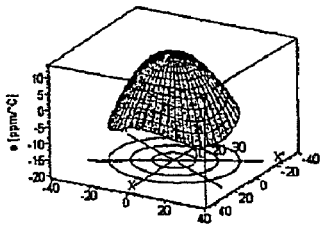
Fig. 2.a
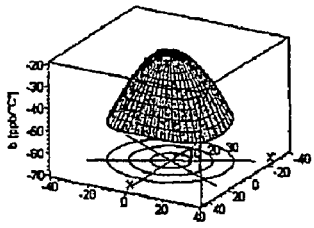
Fig. 2.b
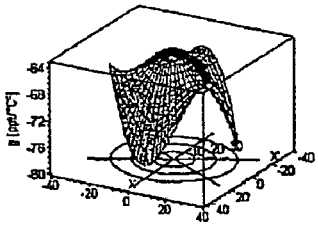
Fig. 2.c

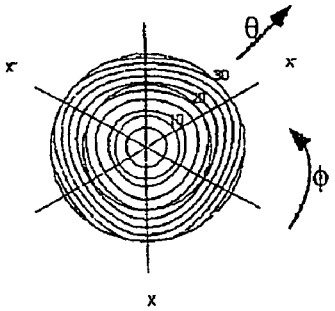
Fig. 3.a
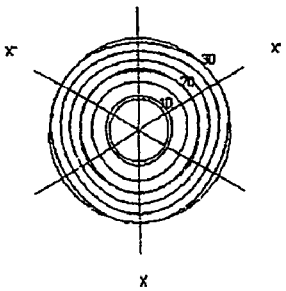
Fig. 3.b
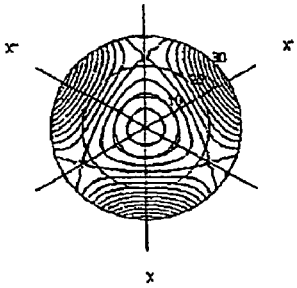
Fig. 3.c
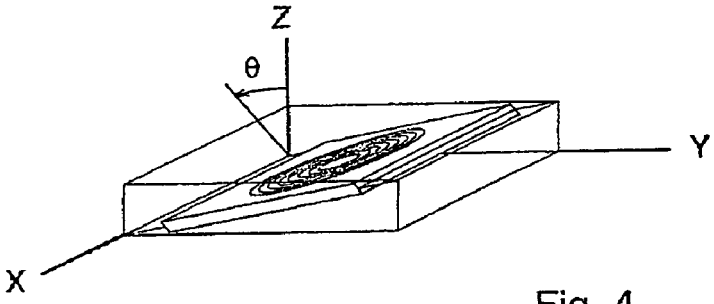
Fig. 4

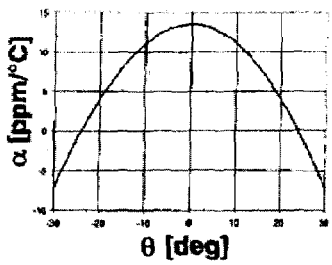
Fig. 5.a
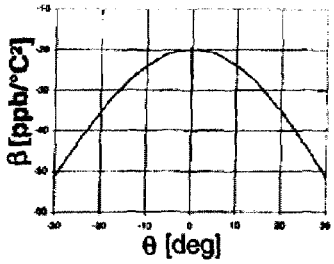
Fig. 5.b
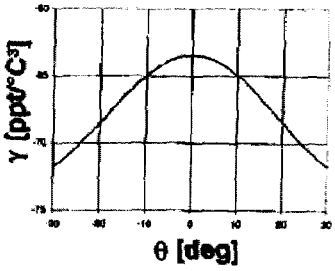
Fig. 5.c
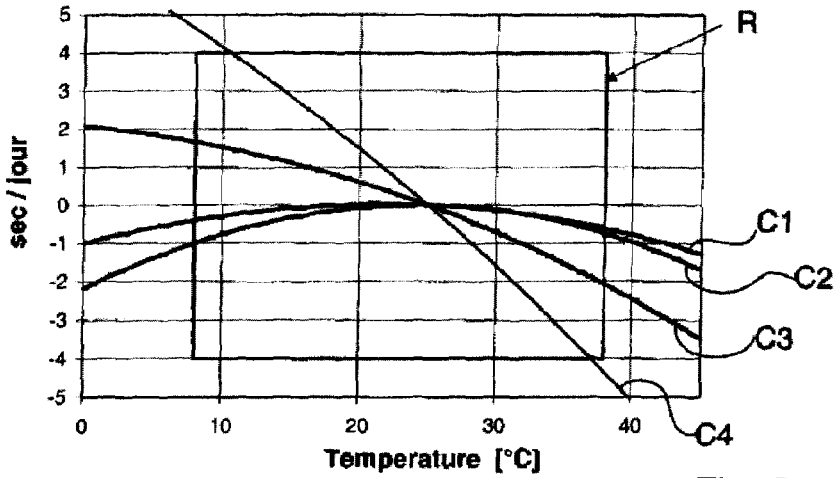
Fig. 6
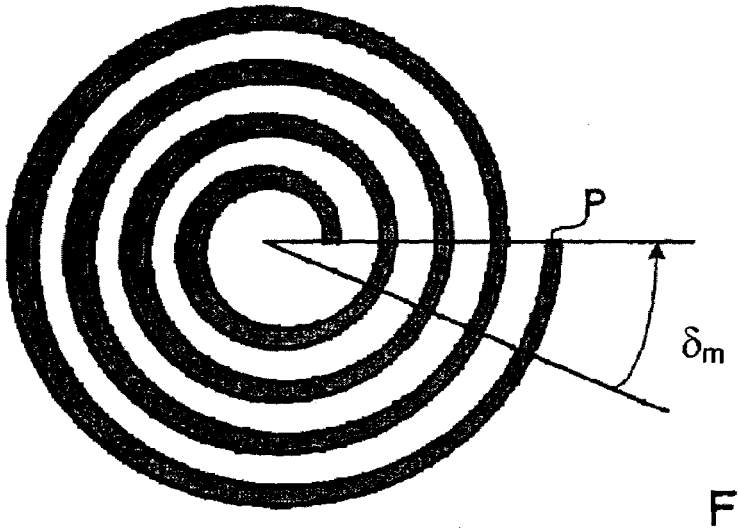
Fig. 7

TEMPERATURE-COMPENSATED BALANCE WHEEL/HAIRSPRING OSCILLATOR

TECHNICAL FIELD

The present invention relates to mechanical oscillators in general and more particularly to mechanical oscillators for watches, which comprise a temperature-compensated assembly formed from a hairspring and a balance wheel.

BACKGROUND

The mechanical oscillators, also called regulators, of timepieces are composed of a flywheel, called a balance wheel, and a spiral spring, called a hairspring, which is fixed, on the one hand, to the balance wheel staff and, on the other hand, to a pallet bridge in which the balance wheel staff pivots. The balance wheel/hairspring oscillates about its equilibrium position at a frequency that must be kept as constant as possible, as it determines the operation of the timepiece. For a homogeneous and uniform hairspring, the period of oscillation of such oscillators is given by the expression:

$$T = 2\pi\sqrt{\frac{J_b \cdot L_s}{E_s \cdot I_s}}$$

in which:

$J_b$ is the total moment of inertia of the balance wheel/hairspring;

$L_s$ represents the active length of the hairspring;

$E_s$ is the elastic modulus of the hairspring; and $I_s$ is the second moment of section of the hairspring.

A temperature variation results in a variation in the oscillation period such that, to the first order:

$$\frac{\Delta T}{T} = \frac{1}{2}\left\{\frac{\Delta J_b}{J_b} + \frac{\Delta L_s}{L_s} - \frac{\Delta E_s}{E_s} - \frac{\Delta I_s}{I_s}\right\}$$

i.e. an expansion effect on $J_b$, $L_s$ and $I_s$ and a thermoelasticity effect on $E_s$. With an increase in temperature, the first three terms are generally positive (expansion of the balance wheel, elongation of the hairspring and reduction in Young's modules) and bring about a loss, whereas the last term is negative (increase in the cross section of the hairspring) and brings about a gain.

In the past, several methods for compensating for the temperature drift of the frequency have been proposed in order to alleviate this problem. Mention may in particular be made of methods of compensation by thermal modification of the moment of inertia of the balance wheel (for example a bimetallic balance wheel made of steel and brass) or by the use of a special alloy (for example invar) for hairsprings having a very low thermoelastic coefficient. These methods remain complicated, difficult to implement and consequently expensive.

More recently, in its European patent application EP 02026147.5 the Applicant described a method for the thermal compensation of the spring constant of a spiral spring, consisting in thermally oxidizing a hairspring produced in a silicon substrate. In the case of hairsprings made of steel of the invar type (for example the house alloy Nivarox-Far S.A.), spiral springs made of oxidized silicon make it possible to regulate the thermal behavior of the spring itself, possibly with a slight overcompensation by a few ppm/° C. This overcompensation limitation is due to the maximum oxide thickness that can be produced in practice (currently less than 4 μm) and to the minimum tolerable width of the cross section of the silicon hairspring (greater than 40 μm). Consequently, the balance wheel must also be thermally compensated. This can be obtained, for example, using an alloy of the "glucydur" type (a copper-beryllium alloy, also called "glucinium") or else other alloys having a very low thermal expansion coefficient. This method is also complicated and, no more than the other more conventional methods, does not make it possible to correct for other isochronism defects, such as those due for example to various frictional effects in the oscillator, to the balance wheel being out of balance, to the center of mass of the hairspring being off-center, etc.

SUMMARY OF THE INVENTION

One object of the present invention is to alleviate the drawbacks of the prior art by proposing a hairspring, for a timepiece oscillator, the behavior of which with respect to thermal variations is such that it makes it possible to keep the balance wheel/hairspring assembly as little dependent as possible on said thermal variations. More precisely, the hairspring of the invention is not only auto-compensated but it can be produced so as to also compensate for the thermal drift of the balance wheel.

Another object of the invention is to be able to also compensate for the isochronism defects inherent in the construction of the balance wheel/hairspring.

These objects are achieved with the oscillator having the features defined in the claims.

More precisely, the hairspring of the invention is produced in a crystalline quartz substrate, the cut of which is chosen in such a way that the assembly, consisting of the hairspring and the balance wheel, is then thermally compensated.

According to another feature of the invention, the shape of the hairspring is chosen so as to compensate for the anisochronism defects of the balance wheel/hairspring assembly.

Quartz is well known in the field of electronic watches and has been studied in order to serve as an oscillator thanks to the phenomenon of piezoelectricity. Through the influence of the conventional horology vocabulary, the term oscillator is used, whereas the term vibration mode is more applicable. The frequencies reached are about 32 kHz. The behavior of quartz crystals used is not necessarily stable under the operating conditions and also, to alleviate this drawback, the quartz crystal cuts are chosen so as to combine various vibration modes so as to obtain an overall stable behavior.

Now, the spiral balance wheels used in mechanical timepieces do actually oscillate, and the phenomenon is purely mechanical. The oscillation frequencies are at most about 5 Hz.

The behavior of quartz in the above two applications is absolutely not similar. To a person skilled in the art, there is no reason to use in mechanical timepieces information deriving from electronic watches. The accumulated knowledge about quartz oscillators used in electronic watches really cannot be directly transposed to spiral springs.

The thermal behavior of quartz spiral springs is essentially determined by the angle of inclination of the cut to the optical axis Z of the quartz crystal. As shown in FIG. 1, the plane of the hairspring may be identified by a ZY/ϕ/θ double rotation (the notation according to the IEEE standards), where ϕ is the longitude and θ is the colatitude (inclination of the hairspring axis to the optical axis Z of the crystal).

The rigidities of the crystals, both in tension and in shear, generally have a thermal point of inversion close to 0° C. with a negative curvature. They become more rigid at low temperature. Their first thermal coefficient at room temperature, i.e. 25° C., is therefore generally negative with a negative curvature. It varies from a few tens to a few hundred ppm/° C. Quartz is one of the rare crystals that makes it possible, at room temperature, to cancel out the first thermal coefficient of rigidity by means of the cut, that is to say the orientation of the structure, and even to make it positive with a value of a few tens of ppm/° C.

Unlike hairsprings made of oxidized silicon or of invar-type steel, a quartz hairspring does not require a glucydur-type compensated balance wheel. It makes it possible to compensate for the thermal drift of most standard bottom-of-the-range balance wheels made of stainless steel and even, in certain regards, to make it more favorable than that of a 32 kHz quartz tuning fork.

The balance wheel/hairspring oscillator according to the invention also possesses all or certain of the features indicated below:

- the hairspring is produced in a quartz substrate, the cut of which is a double ZY/ϕ/θ rotation cut;
- the hairspring is produced in a quartz substrate, the cut of which is a single X/θ rotation cut;
- the hairspring is produced in a quartz substrate, the cut of which is a single Y/θ rotation cut;
- the angle θ is such that the first-order thermal coefficient α of said hairspring compensates for the thermal drift of the balance wheel;
- the angle θ is such that the curve representing the thermal drift of the balance wheel/hairspring assembly remains contained within the horological template; and
- the thickness and, possibly, the pitch of the hairspring are modulated so as to compensate for the isochronism defects of the balance wheel.

BRIEF DESCRIPTION OF THE DRAWINGS

Other objects, features and advantages of the present invention will become apparent on reading the following description given by way of nonlimiting example and in conjunction with the appended drawings in which:

FIG. 1 shows a quartz plate having undergone a ZY/ϕ/θ double rotation relative to the axes of the crystal;

FIGS. 2.*a* to 2.*c* show the behavior of the first α, second β and third γ thermal coefficients of the rigidity of a hairspring produced in a plate such as that of FIG. 1 as a function of the angles θ and ϕ;

FIGS. 3.*a* to 3.*c* show the level curves of these same thermal coefficients;

FIG. 4 shows a quartz plate that has undergone a single rotation about the X axis;

FIGS. 5.*a* to 5.*c* show the variations in the thermal coefficients α, β and γ of the rigidity for a hairspring produced in the plate of FIG. 4;

FIG. 6 shows the thermal drift of the frequency with matching of the X/θ cut of the hairspring to the coefficient α of the balance wheel; and FIG. 7 shows an exemplary embodiment of a hairspring with anisochronism compensation.

DETAILED DESCRIPTION

As indicated above, the thermal behavior of a quartz hairspring depends essentially on the cut of the plate in which it is produced. Thus, for a ZY/ϕ/θ double rotation cut, as shown in FIG. 1, the first-order thermal coefficient α, the second-order thermal coefficient β and the third-order thermal coefficient γ of the rigidity of the hairspring are shown in FIGS. 2.*a* to 2.*c* respectively, for a temperature of 25° C. The vertical axis indicates the values of α, β and γ, in ppm/° C., in ppb/° $C.^2$ and ppt/° $C.^3$ respectively. FIGS. 3.*a* to 3.*c* show the level lines of the graphs of FIG. 2. Considering FIG. 3.*a* in particular, which relates to the first thermal coefficient α, it should be noted that the value of the latter is practically independent of the angle ϕ, but varies with the angle θ. Since, moreover, the contribution of the second-order and third-order thermal coefficients proves to be negligible, it follows that a single-rotation cut, for example an X/θ cut, is sufficient to produce a hairspring according to the invention, that is to say capable not only of compensating for its own thermal drift but also that of the balance wheel with which it is associated. A plate possessing such a cut is shown in FIG. 4. It is obtained by a single rotation of θ about the optical axis X of the crystal. The hairsprings produced in a plate of this type will have a maximum elastic symmetry, namely a symmetry with respect to the YZ plane and a symmetry with respect to the axis of the hairspring (the Z' axis after rotation). These hairsprings will therefore be elastically better balanced than those produced in a double-rotation cut plate and to be so without any limitation on their thermal compensation capability. It should be pointed out that the simple rotation may also be performed about the Y axis.

FIGS. 5.*a* to 5.*b* show the variation, as a function of the angle θ, of the thermal coefficients α, β and γ of the rigidity, respectively, for a hairspring formed from an X/θ single-rotation cut. The coefficients are practically symmetrical with respect to the axis θ=0. If only the first coefficient α is considered (the other coefficients of higher order having a much lower and possible negligible influence), it should be noted that this is equal to zero for θ=±24.0° and that it is a maximum for θ=0. At this point, α is equal to 13.466 ppm/° C., which corresponds to the maximum thermal compensation that it is possible to achieve with a hairspring made of quartz with an X/θ=0 cut. The thermal drift of the balance wheel depends on the material from which it is made. Thus, current stainless steels have a thermal expansion coefficient that typically varies between 10 and 15 ppm/° C., whereas for brass the value of this coefficient is 17 ppm/° C. FIG. 6 shows a few examples of thermal compensation that can be achieved, for various balance wheel materials, with hairsprings of X/θ single-rotation cut. Curves C1 to C3 show the thermal drift of the frequency of oscillators comprising steel balance wheels of various types, while curve C4 corresponds to that of an oscillator with a brass balance wheel. It should be noted that, with respect to the horilogical template (frame R) imposed for watches/chronometers (a frequency variation of less than±8 s/day in the 23° C.±15° C. temperature range), it is possible to find the X/θ cut of the quartz hairspring that makes it possible to compensate for the drift of the more common balance wheels, such as steel balance wheels. For a brass balance wheel (curve C4) however, the maximum compensation of the quartz hairspring does not make it possible to completely satisfy the requirements of this horological template. It is therefore possible, for a given balance wheel material, to determine the angle θ of the cut of the quartz hairspring that offers the best possible thermal compensation of the regulator assembly.

According to another feature of the invention, the quartz hairspring also makes it possible to compensate for isochronism defects of the oscillator. One of the main sources of anisochronism is the variation in amplitude of the oscillations of the balance wheel. The anisochronism variation may be of the order of a few ppm/degree of angle, typically 2 ppm/degree of angle, with a typical angle variation of ± 25%. A known method for compensating for an isochronism consists in acting on the curvature of the end of the hairspring near the balance wheel stud P. This method requires an adjustment step by especially trained personnel—this is not an optimum situation in terms of industrialization. According to a variant of the invention, it is proposed to act on the local rigidity of the turn by varying the width of its cross section. The modulation has the effect of increasing the inertia and the local rigidity of the turn in the sector on the opposite side from the stud. The modulation function of the width of the cross section is, for example, of the $k*\cos(\delta_m-\delta)$ type, where k is a proportionality coefficient, $\delta$ represents the polar angle in the cross section in question and $\delta_m$ is the value of the polar angle at the balance wheel stud. When k is equal to 0.4, the anisochronism compensation is about 1 ppm/degree of angle. The precise value of k for a given oscillator may be determined empirically or by means of numerical simulation. FIG. 7 shows a hairspring having such a modulation in the width of its cross section. The cross sectional width modulation of the turns may be accompanied by modulation of the pitch between the turns so that the gap between these turns remains constant. The latter modulation (not shown) makes it possible to prevent sticking between turns when there are large amplitudes of oscillation. The hairspring described above may be manufactured by any means known to those skilled in the art for machining quartz, such as wet (chemical) etching or dry (plasma) etching.

Although the present invention has been described in relation to particular exemplary embodiments, it will be understood that it is capable of modifications or variants without thereby departing from its scope. For example, other types of modulation of the thickness of the turns may be envisaged, such as a linear variation of the thickness of the turn from the center of the hairspring toward the stud, whether or not this is accompanied by an increase in the inter-turn pitch.

The invention claimed is:

1. A mechanical oscillator comprising a hairspring and a balance wheel, the hairspring having turns and an end for connection to a stud and being produced in a quartz substrate, the cut of which is a double ZY/$\phi$/$\theta$ rotation cut, wherein $\theta$ has a value between −24° and +24° that provides a double rotation cut so that the first-order thermal coefficient $\alpha$ of the rigidity of said hairspring compensates for the thermal drift of the balance wheel with which it is associated, and wherein $\phi$ is the longitude and $\theta$ is the inclination of the hairspring axis to the optical axis Z of the crystal.

2. The mechanical oscillator of claim 1, wherein the angle $\theta$ is determined so that a curve representing the thermal drift of said oscillator remains contained within a horological template.

3. The mechanical oscillator of claim 1, wherein a cross-sectional width of a section of the hairspring is varied so as to compensate for an isochronism defect of the balance wheel.

4. The mechanical oscillator of claim 3, wherein said width variation is a periodic function of the $k*COS(\delta_m-\delta)$ type, where k is a proportionality coefficient chosen in real numbers, $\delta$ is the polar angle of the hairspring section in question and $\delta_m$ is the polar angle of the position of the end for connection to the hairspring stud.

5. The mechanical oscillator of claim 4, wherein said proportionality coefficient is equal to 0.4.

6. The mechanical oscillator as claimed in claim 3, wherein the turns of the hairspring form a spiral extending outward from a center, and wherein said width variation is a linear variation of width from the center of the spiral toward its stud.

7. The mechanical oscillator as claimed in claim 3, wherein the hairspring has turns that are varied in pitch to provide a constant gap between two successive turns for preventing sticking between said successive turns during large amplitudes of hairspring oscillation.

* * * * *